US006000917A

United States Patent [19]

Smerud et al.

[11] Patent Number: 6,000,917

[45] Date of Patent: Dec. 14, 1999

[54] CONTROL OF SUCTION GAS AND LUBRICANT FLOW IN A SCROLL COMPRESSOR

[75] Inventors: Scott J. Smerud; Daniel R. Crum; Bill P. Simmons, all of La Crosse, Wis.

[73] Assignee: American Standard Inc., Piscataway, N.J.

[21] Appl. No.: 08/965,590

[22] Filed: Nov. 6, 1997

[51] Int. Cl.[6] ..... F04B 17/00

[52] U.S. Cl. ..... 417/368; 417/53; 417/366

[58] Field of Search ..... 417/53, 374, 368, 417/366, 94; 418/55.6

[56] References Cited

U.S. PATENT DOCUMENTS

| | | | |
|---|---|---|---|
| 4,496,293 | 1/1985 | Nakamura et al. | 417/371 |
| 4,564,339 | 1/1986 | Nakamura et al. | 417/366 |
| 4,575,320 | 3/1986 | Kobayashi et al. | 418/55 |
| 4,592,703 | 6/1986 | Inaba et al. | 417/366 |
| 4,621,993 | 11/1986 | Nakamura et al. | 418/55 |
| 4,623,306 | 11/1986 | Nakamura et al. | 418/55.6 |
| 4,886,435 | 12/1989 | Sawai et al. | 418/55.3 |
| 5,007,809 | 4/1991 | Kimura et al. | 417/371 |
| 5,055,010 | 10/1991 | Logan | 417/410.5 |
| 5,114,322 | 5/1992 | Caillat et al. | 418/55.6 |
| 5,176,506 | 1/1993 | Siebel | 417/368 |
| 5,219,281 | 6/1993 | Caillat et al. | 418/55.6 |
| 5,240,391 | 8/1993 | Ramshankar et al. | 417/410 |
| 5,366,352 | 11/1994 | Deblois et al. | 417/292 |
| 5,439,361 | 8/1995 | Reynolds et al. | 418/55.6 |
| 5,476,369 | 12/1995 | Fowlkes et al. | 417/410.5 |
| 5,505,596 | 4/1996 | Nakamura et al. | 418/55.6 |
| 5,533,875 | 7/1996 | Crum et al. | 417/368 |

FOREIGN PATENT DOCUMENTS

| | | | |
|---|---|---|---|
| 0236665 | 9/1987 | European Pat. Off. | F04C 18/02 |
| 0798465A1 | 10/1997 | European Pat. Off. | F04C 29/02 |
| WO9714891 | 4/1997 | WIPO | F04C 29/02 |

*Primary Examiner*—Charles G. Freay
*Assistant Examiner*—Robert Z. Evora
*Attorney, Agent, or Firm*—William J. Beres; William O'Driscoll; Peter D. Ferguson

[57] ABSTRACT

The flow, use, interaction and separation of lubricant and gas flowing through the suction pressure portion of a low-side refrigeration scroll compressor is managed by the use of a multi-ported frame in conjunction with separate suction gas supply and lubricant return passages cooperatively defined by the compressor shell and the stator of the motor which drives the compressor.

30 Claims, 6 Drawing Sheets

CONTROL OF SUCTION GAS AND LUBRICANT FLOW IN A SCROLL COMPRESSOR

BACKGROUND OF THE INVENTION

The present invention relates to scroll compressors. More specifically, the present invention relates to the controlled flow of lubricant and suction gas in and through a hermetic low-side refrigerant scroll compressor.

Low-side compressors are compressors in which the motor by which the compressor's compression mechanism is driven is disposed in the suction pressure portion (low-side) of the compressor shell. In the case of a scroll compressor, the motor most often drives one of the two scroll members which comprise the compressor's compression mechanism and which are constrained, by use of a device such as an Oldham coupling, to relative motion such that one scroll member orbits with respect to the other.

Such orbital motion, in the proper direction, causes the cyclical creation of pockets at the radially outward ends of the interleaved involute wraps of the scroll members. During compressor operation, such pockets fill with suction gas, close and are displaced radially inward while decreasing in volume thereby compressing the gas trapped in them. The compression pockets are ultimately displaced into communication with a discharge port, most often located at the center of the scroll set, and the compressed gas is expelled therethrough.

In low-side scroll compressors used in refrigeration applications, relatively oil-free refrigerant gas at suction pressure must be delivered to the vicinity of the suction pockets that are cyclically defined at the radially outward ends of the wraps of the scroll members. At the same time, however, provision must be made for the lubrication of the bearings in which the drive shaft and driven scroll member rotate as well as for the lubrication of other components and surfaces in the suction pressure portion of the compressor shell. As a result, the delivery of lubricant to surfaces requiring lubrication in the low-side of the shell of a refrigeration scroll compressor, its return to the lubricant sump therein and the interaction of such lubricant with the suction gas flowing to the compression mechanism therethrough must be carefully managed and controlled so as to maximize compressor efficiency while providing adequate lubrication where and when needed.

One arrangement by which suction gas and lubricant flow are controlled in a low-side scroll compressor is taught in U.S. Pat. No. 5,533,875, assigned to the assignee of the present invention and incorporated herein by reference. In that arrangement, use is made of a sleeve mounted in the suction pressure portion of the compressor shell and in which the compressor drive motor is mounted so as to control and isolate lubricant and suction gas from each other as they flow through the low-side of the compressor. The use of such a sleeve, while effective, brings with it certain disadvantages and costs both in terms of the compressor's material cost and in terms of the compressor assembly process.

SUMMARY OF THE INVENTION

It is an object of the present invention to control and manage the flow of refrigerant gas in the suction pressure portion of a low-side refrigeration scroll compressor.

It is a further object of the present invention to control and manage the flow of lubricant in the suction pressure portion of a low-side refrigeration scroll compressor.

It is a still further object of the present invention to control and manage the flow, use, interaction and separation of lubricant and suction gas in a low-side refrigerant scroll compressor in a manner which enhances compressor efficiency yet ensures that adequate lubrication is provided for where and when needed in the suction pressure portion of the compressor shell.

It is another object of the present invention to take advantage of pressure differentials which develop in the suction pressure portion of a low-side scroll compressor, when the compressor is in operation, to assist in the delivery of lubricant to surfaces within that portion of the compressor that require lubrication.

It is still another object of the present invention to provide a refrigeration scroll compressor in which the compressor drive motor is supported directly by the shell of the compressor and in which the flow, use, interaction and separation of lubricant and suction gas is effectively managed through the use of a multi-ported frame so as to prevent the flow of excessive amounts of lubricant out of the compressor in the discharge gas stream and reduce the cost of such compressors in terms of both their constituent parts and the complexity and expense of their fabrication and assembly.

These and other objects of the present invention, which will be appreciated when the following Description of the Preferred Embodiment and attached drawing figures are considered, are accomplished in a scroll compressor having a drive motor the stator of which is mounted directly to the shell of the compressor. The compressor employs a multi-ported frame that, in conjunction with passages cooperatively defined by the compressor shell and drive motor stator, effectively manage the flow, use and interaction of lubricant and suction gas in and through the suction pressure portion of the compressor.

The motor stator and compressor shell cooperate in the definition of a suction gas supply passage to and through which the large majority of suction gas entering the suction pressure portion of the compressor shell is directed and constrained to flow. The primary suction gas stream, which is maintained relatively oil-free, is caused to diverge and flow around the upper portion of the drive motor stator after exiting the supply passage, cooling that portion of the motor in the process. The divergent portions of the gas stream next enter opposed elevated ports defined by the multi-ported frame which open into the vicinity of the opposed pair of suction pockets that are defined by the scroll members and their involute wraps.

Oil is initially pumped upward from a sump in the suction pressure portion of the compressor shell through a gallery defined in the compressor drive shaft. Oil flowing through that gallery is ported to a lower drive shaft bearing, an upper drive shaft bearing and to the surface of a stub shaft at the upper end of the drive shaft which drives the driven scroll member. The delivery of oil to the bearing surfaces and stub shaft is assisted by the venting of the drive shaft oil gallery to a location in the suction pressure portion of the compressor shell which, when the compressor is in operation, is at a reduced pressure in comparison to the pressure of the oil sump.

The multi-ported frame is configured to collect such lubricant, once used, in an internally defined cavity and return it to the compressor's oil sump via an essentially discrete oil-return path which is effectively isolated from the primary suction gas flow path through the suction pressure portion of the compressor that leads to the scroll set. In that regard, oil collected in the cavity defined by the multi-ported frame flows from the cavity through a port which is configured to direct such return oil away from the stream of suction gas which flows exterior of and partially around the multi-ported frame and around the upper end of the drive motor stator enroute to the elevated suction gas apertures defined by the frame. Such oil is directed into an oil return passage that is at least partially defined by the stator of the compressor drive motor and the compressor shell. The geometry of the multi-ported frame and the location of the suction gas supply and oil return apertures defined therein, together with the opposing locations of the separate suction gas supply and oil return passages that are cooperatively defined by the compressor shell and drive motor stator, serve to keep the suction gas which flows to the scroll set essentially separate from the oil which is used in the suction pressure portion of the compressor shell while achieving the cooling of the drive motor by suction gas.

DESCRIPTION OF THE DRAWING FIGURES

DESCRIPTION OF THE PREFERRED EMBODIMENT

Figure 1:
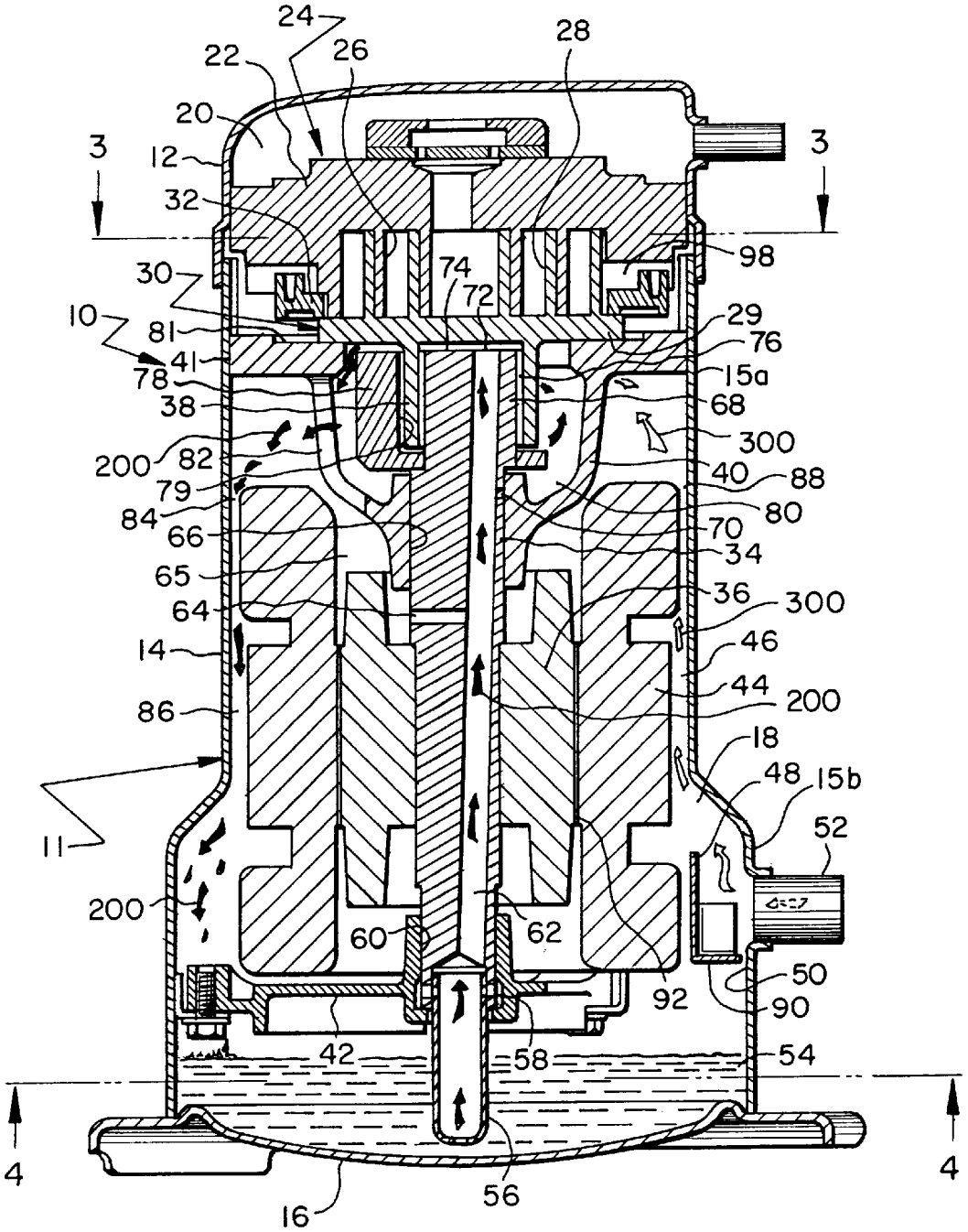
FIG. 1 is a cross-sectional view of the low-side refrigerant scroll compressor of the present invention best illustrating the opposed suction gas and oil return flow paths in the suction pressure portion of the compressor's shell.
Figure 2:
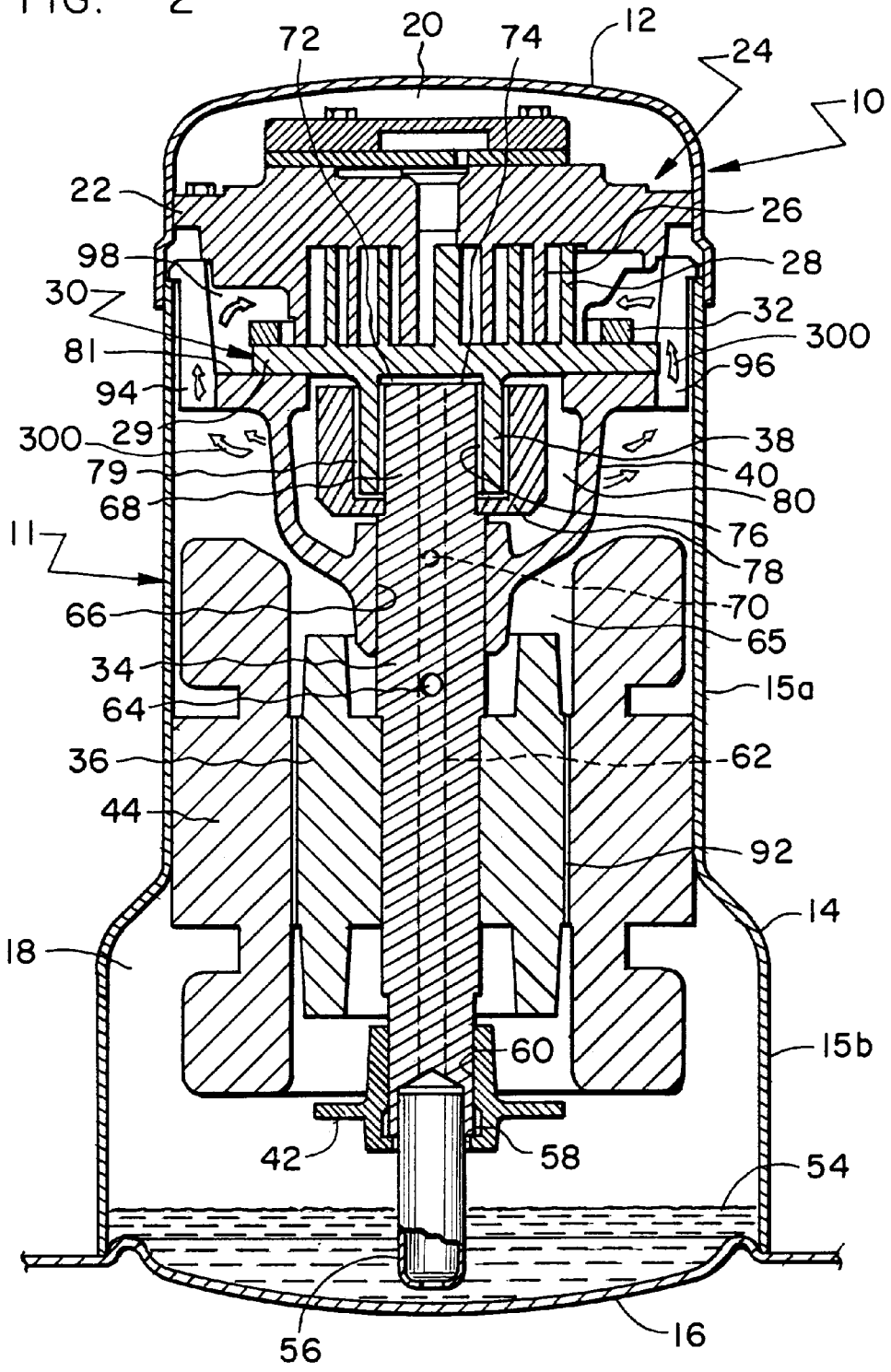
FIG. 2 is likewise a cross-sectional view of the compressor of the present invention but taken at a 90° angle from the cross-sectional view of FIG. 1 and illustrating the divergent suction gas flow path leading to the scroll set in the upper portion of the compressor shell.
Figure 3:
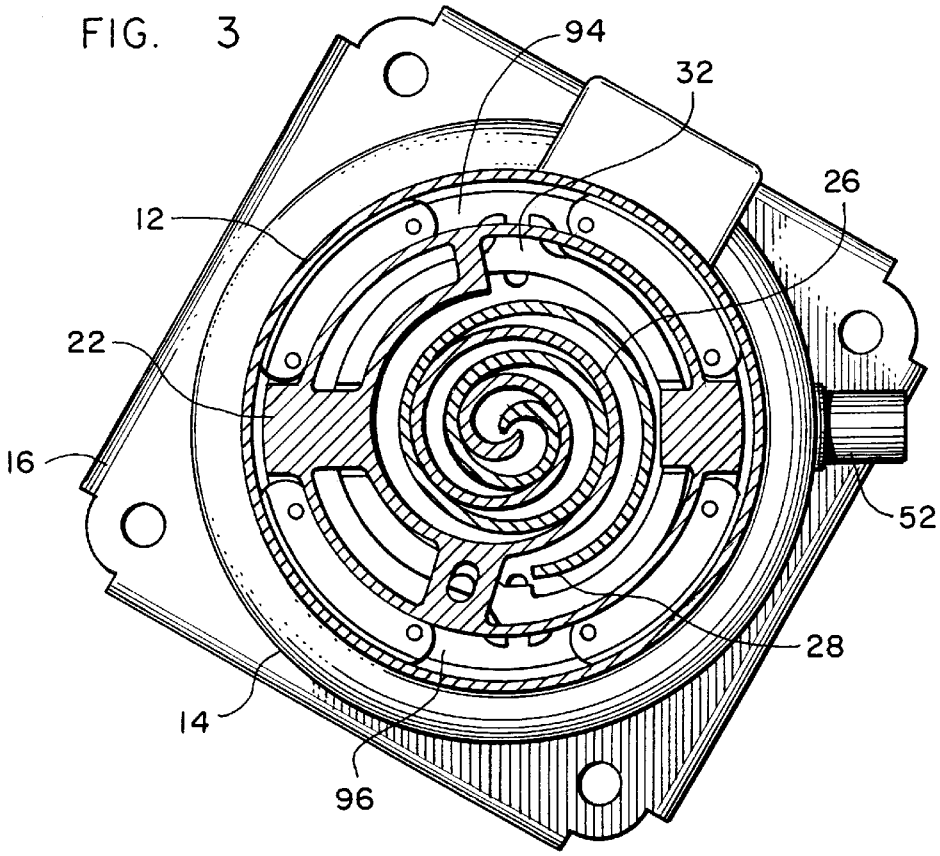
FIG. 3 is a view taken along line 3—3 of FIG. 1.
Figure 4:
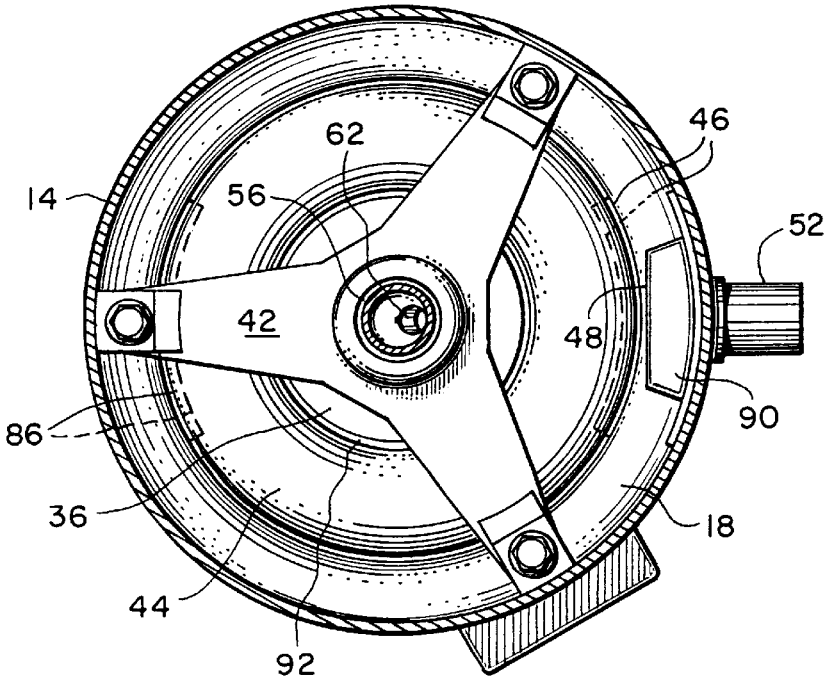
FIG. 4 is a view taken along 4—4 of FIG. 1.
Figure 5:
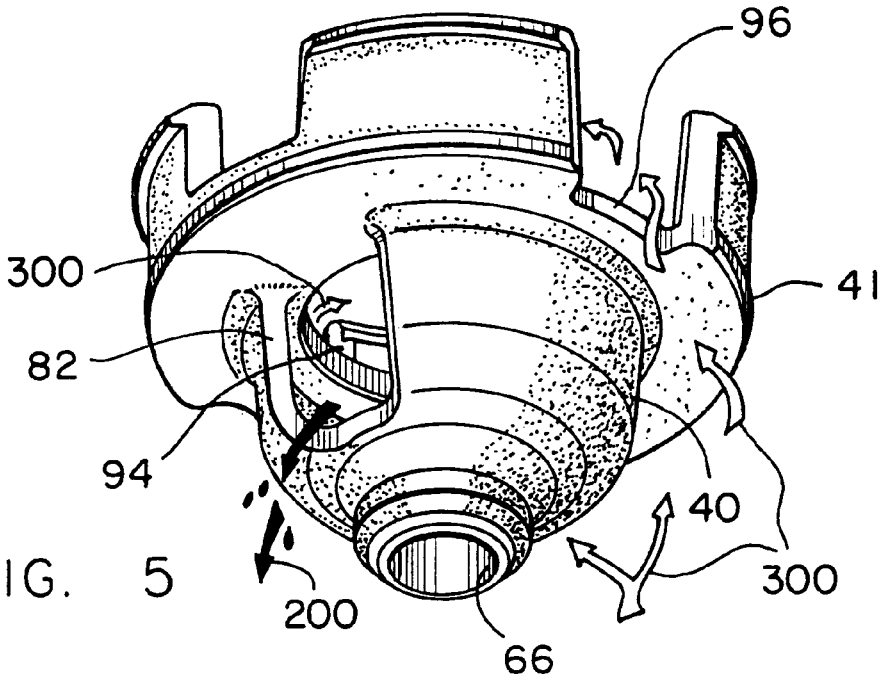
FIG. 5 is a perspective view of the multi-ported frame in which the drive shaft of the compressor drive motor rotates and which, together with other compressor components, define discrete gas and lubricant flow paths within the suction pressure portion of the compressor's shell.
Figure 10:
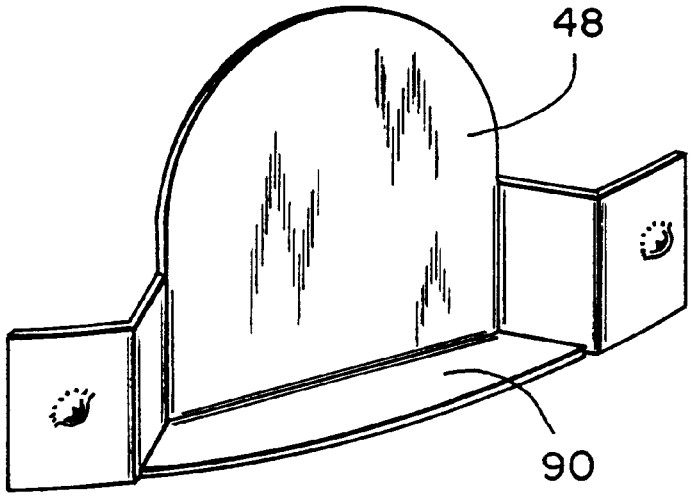
FIG. 10 is a perspective view of the suction gas baffle of the compressor of the present invention.
Figure 6:
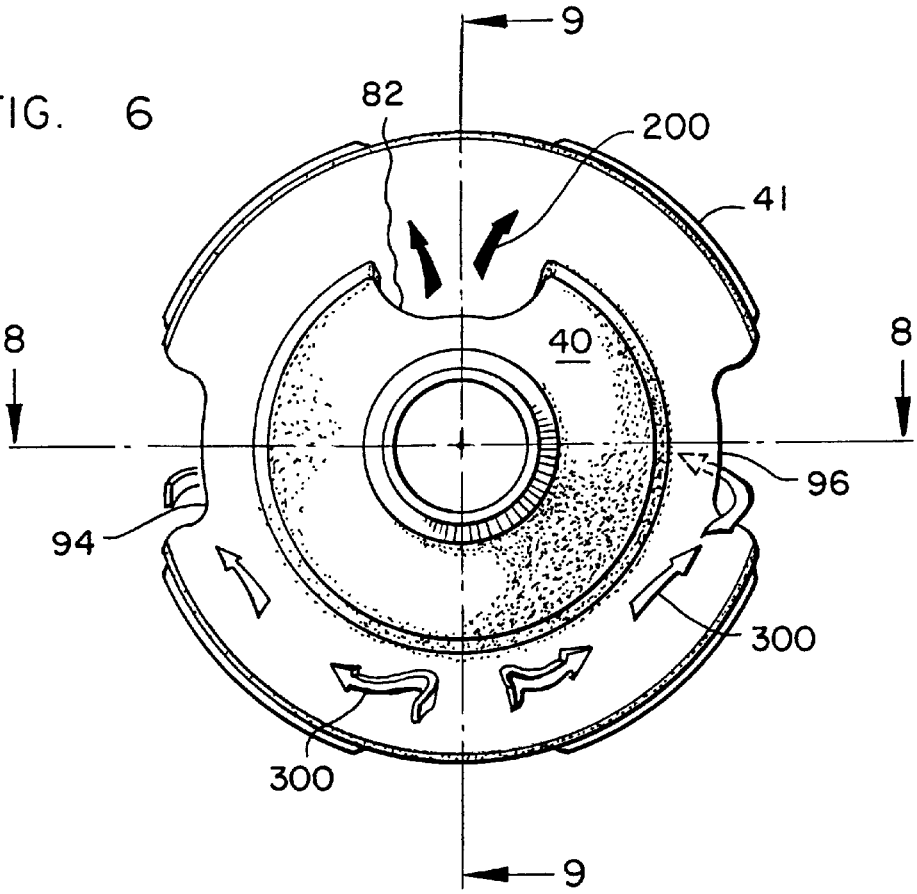
FIG. 6 is a bottom view of the multi-ported frame of FIG. 5.
Figure 7:
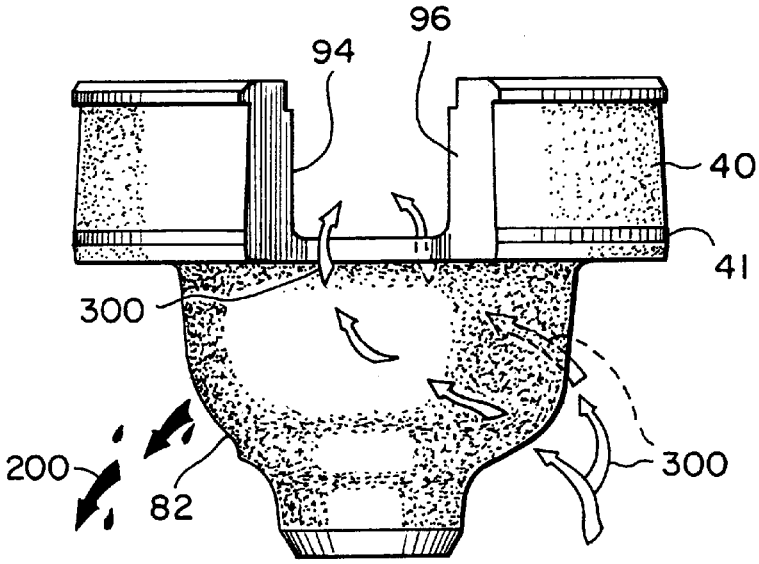
FIG. 7 is a side view of the multi-ported frame of FIG. 3 illustrating the apertures through which suction gas is delivered to the scroll set.
Figure 8:
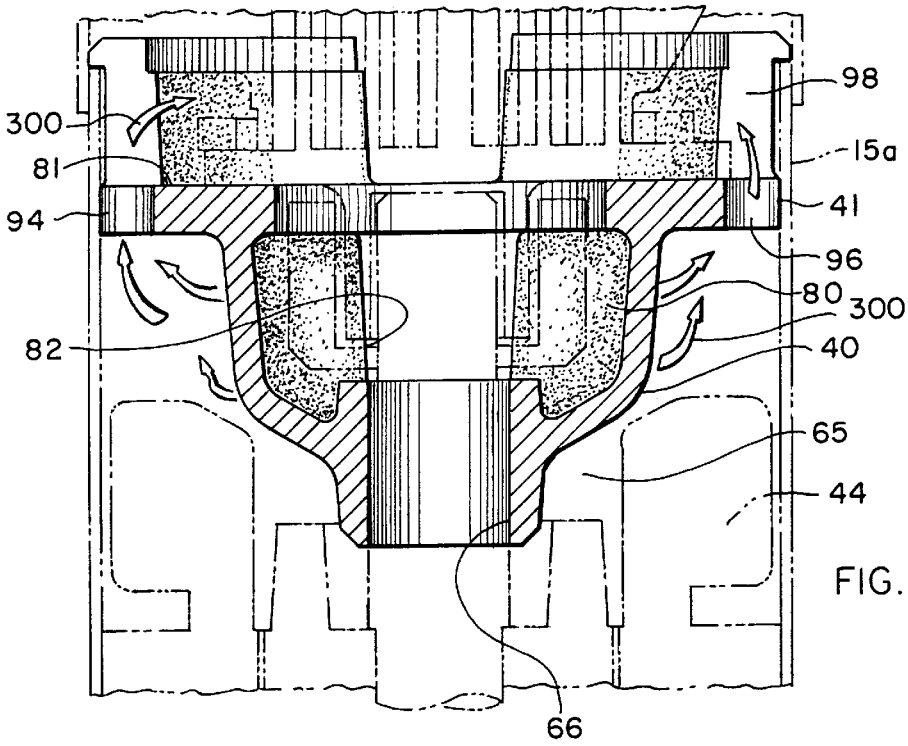
FIG. 8 is a cross-sectional view of the multi-ported frame of FIG. 6 taken along line 8—8 thereof, line 8—8 bisecting the apertures through which gas is delivered to the scroll set.
Figure 9:
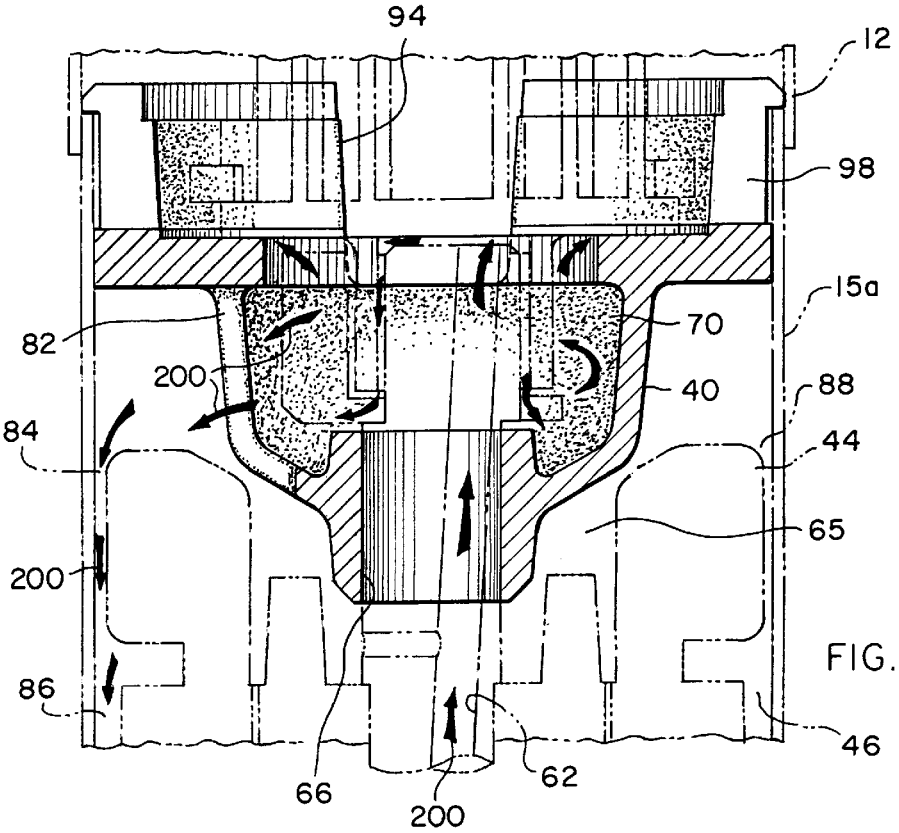
FIG. 9 is a cross-sectional view of the multi-ported frame of FIG. 6 taken along line 9—9 thereof, line 9—9 bisecting the aperture through which oil is returned to the sump in the low side of the compressor.

Referring first to Drawing FIGS. 1, 2, 3 and 4, it is noted that FIGS. 1 and 2 are cross-sectional views of scroll compressor 10 of the present invention taken 90° apart with FIG. 1 best illustrating the opposed relationship of the suction gas delivery and oil return paths past the motor stator in the compressor of the present invention. Solid arrows illustrated within the drawing figures generally connote the flow of lubricant and exemplary ones of such arrows are numbered with the numeral 200. Hollow arrows generally connote suction gas flow and exemplary ones of such arrows are numbered 300. It should be understood that while the preferred embodiment of the present invention is directed to a scroll compressor of the fixed/orbiting type, the present invention likewise has application to scroll compressors of other types.

Compressor 10 has a hermetic shell 11 which consists of a cap 12, a middle shell 14, and a base plate 16. Middle shell 14 has a reduced diameter portion 15*a* and a larger diameter lower portion 15*b*. Shell 11 is divided into a low-side or suction pressure portion 18 and a high-side or discharge pressure portion 20 by, in the preferred embodiment, the end plate 22 of fixed scroll member 24.

Fixed scroll member 24 has a scroll wrap 26 extending from its end plate 22 which is in interleaved engagement with scroll wrap 28 that extends from end plate 29 of orbiting scroll member 30. Together, scroll members 24 and 30 comprise the scroll set and the compression mechanism of the compressor. Oldham coupling 32 constrains scroll member 30 to orbit with respect to fixed scroll member 24 when the compressor is in operation.

Orbiting scroll member 30 is driven by drive shaft 34 on which motor rotor 36 is mounted. In the preferred embodiment, a boss 38 depends from orbiting scroll member 30 on the side opposite of end plate 29 from which scroll wrap 28 extends while drive shaft 34 is supported for rotation within multi-ported frame 40 and lower frame 42, both of which are fixedly mounted within or to the compressor shell. As will subsequently be more thoroughly described, surface 41 of frame 40 cooperates with reduced diameter portion 15*a* of middle shell 14 in the creation of a boundary/barrier between the relatively oil-free stream of suction gas which is delivered to the scroll set and the flow path by which oil is returned to the sump of compressor 10 after having been used for lubrication in the suction pressure portion of the compressor shell.

Motor stator 44 is fixedly supported, preferably by interference fit, in middle shell 14. In that regard, middle shell 14 will preferably be heat shrunk onto stator 44 although stator 44 could, alternatively, be pressed thereinto.

Middle shell 14 and motor stator 44 cooperate in the definition of a suction gas supply passage 46 which is formed therebetween as a result of a cutout in motor stator 44. Suction gas baffle 48, in the preferred embodiment, is attached to the inner surface 50 of lower portion 15*b* of middle shell 14 and, as will subsequently be described, cooperates with supply passage 46 and multi-ported frame 40 in the delivery of relatively oil-free suction gas to the scroll set. Suction gas is initially delivered into suction pressure portion 18 of compressor 10 through a suction fitting 52 with suction gas baffle 48 being positioned in opposition thereto.

An oil sump 54 is defined in the bottom of shell 11 and a lubricant pump 56 depends thereinto. Lubricant pump 56 is attached to drive shaft 34 and the rotation of pump 56, which results from the rotation of drive shaft 34, induces oil from sump 54 to travel upward through the drive shaft as will subsequently be described. In the preferred embodiment, pump 56 is of the centrifugal type although the use of pumping mechanisms of other types, including those of the positive displacement type, are contemplated.

Debris carried in the oil pumped out of sump 54 by pump 56 is centrifugally spun into an annular debris collection area 58 within lower frame 42. Such debris is returned to the sump through a weep hole, not shown. The oil spun into collection area 58 is end-fed to bearing surface 60 of lower frame 42 in which the lower end of the compressor drive shaft rotates.

Another portion of the oil introduced into drive shaft 34 by the operation of pump 56 continues upward through oil gallery 62 which, in the preferred embodiment, is a slanted passage. A vent passage 64 connects oil gallery 62 with the exterior of the drive shaft in region 65 of suction pressure portion 18 of the compressor shell. Region 65 is located in the vicinity of the upper ends of motor rotor 36 and motor stator 44 and the depending portion of frame 40.

Vent passage 64 is significant for two reasons. First, it permits the outgassing of refrigerant entrained in the oil traversing gallery 62 before such oil is delivered to the upper bearing surface 66 in frame 40. Second, it induces the flow of oil upward within the shaft through gallery 62, in both cases for the reason that region 65 is at a relatively lower pressure than the pressure which exists in oil sump 54 when the compressor is in operation.

In that regard, the location of vent passage 64 and the reduced pressure in the vicinity of its outlet in region 65 results in the existence of a pressure drop in the oil flowing upward through gallery 62 which effectively lifts such oil out of sump 54. This, in turn, reduces the lift which must be accomplished by oil pump 56 itself or, in another sense, increases pump output. The creation of relatively lower pressure in region 65 in the vicinity of vent 64 results from the high speed rotation of the drive shaft and drive motor rotor in the proximity of the upper end of stator 44 and in the vicinity the depending portion of multi-ported frame 40.

Upper bearing surface 66, in which the stub shaft portion 68 of drive shaft 34 is rotatably supported, is fed through a cross-drilled lubrication passage 70 which communicates between gallery 62 and bearing surface 66. Passage 70 opens onto an upper portion of bearing surface 66.

A second or upper oil gallery 72 is defined by the underside of end plate 29 of orbiting scroll member 30, boss 38 and upper end face 74 of stub shaft 68. Oil communicated into upper gallery 72 from drive shaft gallery 62 makes its way down drive surface 76 which is the interface between stub shaft 34 and the interior surface of boss 38.

A counterweight 78 is mounted on drive shaft 34 for rotation therewith. Lubricant which exits the upper portion of bearing surface 66 in the vicinity of the bottom of counterweight 78 intermixes with lubricant which exits the lower portion of drive surface 76 and is thrown centrifugally outward in lubricant collection cavity 80 of multi-ported frame 40 by the high speed rotation of the drive shaft and counterweight therein. It is to be noted that a portion of such oil is urged both centrifugally outward and upward along the inside radius of counterweight 78 through gap 79 which is defined between the counterweight and boss 38. Such oil provides for the lubrication of the underside of orbiting scroll member 30 in its contact with thrust surface 81 which is an upward facing surface of multi-ported frame 40.

Once used for lubrication purposes, oil is directed out of cavity 80 through oil return aperture 82 of multi-ported frame 40 into the vicinity of the entry 84 of oil return passage 86 which aperture 82 is in alignment with. Oil return passage 86, like suction gas supply passage 46, is cooperatively defined by motor stator 44 and middle shell 14. Entry 84 into oil return passage 86 is preferably located 180° around the shell of compressor 10 from exit 88 of suction gas supply passage 46. Oil entering entry 84 of passage 86 drains therethrough back to sump 54.

Focusing now on suction gas flow and with referring to all of the drawing figures, the large majority of the suction gas entering the compressor shell through suction fitting 52 impinges upon suction baffle 48 and is directed upward thereby into suction gas supply passage 46. A relatively much smaller portion of the suction gas flows or "spills over" into the lower interior portion of the compressor shell around suction gas baffle 48. Disposition of suction gas baffle 48 in opposition to suction fitting 52, together with its physical geometry which includes a solid base portion 90, shields oil sump 54 from the primary suction gas flowstream thereby advantageously maintaining the oil in sump 54 in a quiescent state while causing essentially oil-free suction gas to be directed into a relatively discrete flow path, proximate the drive motor, to promote its cooling by suction gas enroute to the scroll set.

The majority of the suction gas entering shell 11 travels upward through suction gas supply passage 46 and issues out of exit 88 thereof. The suction gas flow stream issuing from exit 88 diverges and flows in two directions partially around the exterior of multi-ported frame 40 in the proximity of the upper end of motor stator 44. The upward flow of a minor portion of suction gas through rotor-stator gap 92 together with the flow of the relatively much larger and essentially oil-free stream of suction gas flowing through suction gas passage 46 and around the upper portion of motor stator 44 proactively causes the cooling of the compressor drive motor while the compressor is in operation which enhances the reliability of the compressor.

The divergence of the suction gas flow stream issuing out of exit 88 results from the existence of opposing suction gas apertures 94 and 96 in multi-ported frame 40. Apertures 94 and 96 are located above and 90° around the interior of middle shell 14 from exit 88 of suction gas supply passage 46. Suction gas is drawn through apertures 94 and 96 into the suction pockets formed by the relative orbital motion of the scroll members when the compressor is in operation after passing through region 98 which is located exterior of the intermeshed involute wraps of the scroll members. As earlier noted, circumferential surface 41 of the frame 40 and its disposition proximate the interior surface of necked in portion 15*a* of middle shell 11 creates a barrier between relatively oil-free region 98 in the compressor and the area below that region through which oil is returned out of cavity 80 through aperture 82 enroute to sump 54.

It is to be noted that the suction gas flowing into region 98, although relatively very oil-free, will carry with it a small and controlled amount of entrained lubricant. The existence of such lubricant in region 98 is beneficial in that it provides for the lubrication of the Oldham coupling and for the sealing and lubrication of the tips and involute wraps of the scroll members in their juxtaposition to the end plate of the opposing scroll member.

Overall, the suction gas flowing into region 98 is, however, essentially oil-free as a result of shielding of the primary suction gas flow stream from oil sump 54 as it enters shell 11, as a result of the definition of the oil return path below and circumferentially further around frame 40 from the path through which the suction gas stream actively flows to the intermeshed wraps of the scroll members and as a result of the relatively high velocity at which suction gas is drawn out of suction passage 46 into apertures 94 and 96 of frame 40 which maintains that gas stream cohesive and discrete from those locations in the suction pressure portion of the compressor shell where oil content is relatively higher. The net result is to provide for the lubrication of those bearings and surfaces in suction pressure portion 18 of compressor 10 that require lubrication in amounts adequate to meet their lubrication needs while providing for the delivery of relatively oil-free suction gas to the compression mechanism and the proactive cooling of the compressor drive motor.

While the present invention has been described in terms of a preferred embodiment, it will be appreciated that modifications thereto and departures therefrom falling within the scope of the invention are contemplated and are encompassed by the claim language which follows.

What is claimed is:

1. A scroll compressor comprising:

a shell, said shell having a discharge pressure portion and a suction pressure portion, said suction pressure portion defining a lubricant sump and being the portion of said compressor into which suction gas is delivered;

a first scroll member having a scroll wrap;

a second scroll member having a scroll wrap, the wraps of said first and said second scroll members being interleaved; and a motor, said motor having a rotor and a stator, said stator being mounted to said shell in the suction pressure portion thereof, said stator cooperating with said rotor to define a rotor-stator gap and with said shell to define a suction gas supply passage and a lubricant return passage, rotation of the rotor of said motor driving one of said first and said second scroll members, the majority of the suction gas delivered into said suction pressure portion of said shell flowing upward through said suction gas passage and a portion of the suction gas delivered into said suction pressure portion of said shell flowing upward through said rotor stator gap so as to cool said motor.

2. The scroll compressor according to claim 1 further comprising a frame, said frame defining at least one aperture through which suction gas flows to the interleaved wraps of said first and said second scroll members and at least one aperture through which lubricant exits said frame for return to said lubricant sump.

3. The scroll compressor according to claim 2 further comprising a drive shaft, said rotor of said motor being mounted thereon, said drive shaft defining a gallery through which lubricant flows out of said lubricant sump when said compressor is in operation, said drive shaft penetrating said frame and being in driving engagement with one of said first and said scroll members, a portion of the lubricant flowing into said drive shaft gallery being delivered therethrough to a surface within said compressor requiring lubrication and thence into a lubricant collection cavity defined by said frame.

4. The scroll compressor according to claim 3 wherein said lubricant return aperture defined by said frame is in flow communication with said lubricant collection cavity and in general alignment with said oil return passage cooperatively defined by said motor stator and said shell.

5. The scroll compressor according to claim 4 wherein said suction gas supply passage cooperatively defined by said stator and said shell and said lubricant return passage cooperatively defined by said stator and said shell are generally located on opposite sides of said stator within said shell.

6. The scroll compressor according to claim 5 further comprising a baffle for directing a majority of the suction gas which enters said shell into said suction gas supply passage cooperatively defined by said motor stator and said shell.

7. The scroll compressor according to claim 6 wherein said frame defines at least two apertures through which suction gas flows to the interleaved wraps of said first and said second scroll members, said at least two apertures being disposed circumferentially around said frame within said shell such that the flow of suction gas out of said suction gas supply passage cooperatively defined by said motor stator and said shell is caused to diverge, a first portion of said suction gas exiting said supply passage and flowing to said interleaved wraps of said first and said second scroll members through one of said apertures and a second portion of said suction gas existing said supply passage and flowing to the interleaved wraps of said first and said second scroll members through a second of said at least two apertures.

8. The scroll compressor according to claim 7 wherein said frame defines a generally circumferential surface, said surface being juxtaposed the interior surface of said shell such that suction gas flowing to the interleaved wraps of said first and said second scroll members, subsequent to having passed through said at least two gas flow apertures defined by said frame, is shielded from oil flowing out of said oil return aperture defined by said frame.

9. The scroll compressor according to claim 1 wherein said shell is generally cylindrical and has a reduced diameter portion and a larger diameter portion, said sump being defined in said larger diameter portion of said shell and said motor being mounted to said reduced diameter portion of said shell.

10. The scroll compressor according to claim 9 wherein the flow stream of suction gas flowing out of said suction gas supply passage cooperatively defined by said motor stator and said shell is caused to diverge subsequent to exiting said suction gas supply passage and flow at least partially around at the upper portion of said motor so as to cool said motor.

11. The scroll compressor according to claim 10 further comprising a frame, said frame defining first and second apertures through which suction gas flows to the interleaved wraps of said first and said second scroll members and at least one lubricant return aperture through which lubricant exits said frame for return to said sump, the majority of lubricant exiting said aperture in said frame entering said oil return passage defined by said motor stator and said shell.

12. The scroll compressor according to claim 11 wherein said frame defines a cavity in which lubricant collects, said divergent streams of suction gas flowing exterior of said frame, across the upper portion of the stator of said motor and into said first and said second gas flow apertures defined by said frame, said frame defining a barrier between suction gas which has passed through said first and said gas flow second apertures in said frame and lubricant exiting said cavity defined by said frame through said lubricant return aperture.

13. The scroll compressor according to claim 12 further comprising a baffle for directing a majority of the suction gas which enters said shell into said suction gas supply passage cooperatively defined by said motor stator and said shell and wherein suction gas enters said shell in said larger diameter portion of said shell.

14. The scroll compressor according to claim 13 further comprising a drive shaft, said rotor of said drive motor being mounted on said drive shaft and said drive shaft defining a gallery through which lubricant flows from said lubricant sump to a surface in said compressor which requires lubrication when said compressor is in operation, said drive shaft penetrating said frame and being in driving engagement with one of said first and said second scroll members.

15. A scroll compressor comprising:

a shell, said shell having a discharge pressure portion, a suction pressure portion and defining a sump, suction gas being delivered into said suction pressure portion of said shell, said shell further having a reduced diameter portion and a larger diameter portion, said sump being defined in said larger diameter portion;

a first scroll member having a scroll wrap;

a second scroll member having a scroll wrap, the wraps of said first and said second scroll members being interleaved;

a motor, said motor having a rotor and a stator, said rotor and said stator defining a rotor-stator gap, said stator being fixedly and directly supported by said shell in the reduced diameter portion thereof, said stator cooperating with said shell to define a suction gas supply passage and a lubricant return passage, the majority of the suction gas delivered into said suction pressure portion of said shell flowing upward through said suction gas supply passage and a portion of the suction gas delivered into said suction pressure portion of said shell travelling upward through said rotor-stator gap of said motor so as to cool said motor; and a frame, said frame defining a lubricant collection cavity, at least one aperture through which lubricant passes out of said cavity prior to entering said lubricant return passage and at least one aperture through which suction gas flows to the interleaved wraps of said first and said second scroll members subsequent to exiting said suction gas supply passage defined by said motor stator in said shell.

16. The scroll compressor according to claim 15 further comprising a drive shaft, said rotor of said motor being mounted thereon, said drive shaft defining a gallery through which lubricant flows from said lubricant sump to a surface within said cavity defined by said frame which requires lubrication when said compressor is in operation, said drive shaft penetrating said frame and being in driving engagement with one of said first and said second scroll members, lubricant flowing through said gallery being delivered into said cavity defined by said frame subsequent to its use in lubricating said surface.

17. The scroll compressor according to claim 16 wherein suction gas enters said shell in said larger diameter portion thereof.

18. The scroll compressor according to claim 17 wherein said suction gas supply passage defined by said motor stator and said shell and said lubricant return passage defined by said motor stator and said shell are located on generally opposite sides of said stator within said shell.

19. The scroll compressor according to claim 18 further comprising a baffle for directing a majority of the suction gas which enters said shell into said suction gas supply passage cooperatively defined by said motor stator and said shell.

20. The scroll compressor according to claim 19 wherein said lubricant return aperture defined by said frame is in general alignment with said lubricant return passage defined by said motor stator and said shell.

21. The scroll compressor according to claim 20 wherein said frame defines at least two apertures through which suction gas flows to the interleaved wraps of said first and said second scroll members, said at least two apertures being disposed circumferentially around said frame in said shell such that the flow stream of suction gas out of said suction gas supply passage defined by said motor stator and said shell is caused to diverge, a first portion of said suction gas flowing to said interleaved wraps of said first and said second scroll members through one of said apertures and a second portion of said suction gas flowing to the interleaved wraps of said first and said second scroll members through another of said at least two apertures.

22. The scroll compressor according to claim 21 wherein said frame defines a generally circumferential surface, said surface being juxtaposed the interior surface of said reduced diameter portion of said shell such that lubricant flowing out of said lubricant return aperture defined by said frame is isolated from suction gas flowing to the interleaved wraps of said first and said second scroll members subsequent to the passage of said suction gas through said at least two apertures.

23. A method of controlling the flow and interaction of lubricant and refrigerant gas in a refrigeration scroll compressor comprising the steps of:

mounting the stator of the motor which drives said compressor directly to the shell of said compressor;

defining a suction gas flow passage between the stator of the motor which drives the compressor and the shell of the compressor;

defining a gap between the rotor and the stator of said motor;

defining an lubricant return passage between the stator of the motor which drives the compressor and the shell of the compressor;

directing the majority of suction gas entering the shell of said compressor into said suction gas supply passage for upward flow therethrough;

flowing a portion of the suction gas that enters the shell of said compressor into said rotor-stator gap for upward flow therethrough; and directing lubricant, subsequent to its use for lubrication purposes within said compressor, into said lubricant return passage.

24. The method according to claim 23 comprising the further step of locating said suction gas flow passage and said lubricant return passage on generally opposite sides of the shell of said compressor.

25. The method according to claim 24 comprising the further steps of defining a lubricant sump in the shell of said compressor; pumping lubricant from said sump to a surface requiring lubrication within said compressor through a gallery defined in the drive shaft of said compressor; and, defining a cavity in which lubricant collects subsequent to its use in lubricating said surface within said compressor.

26. The method according to claim 25 comprising the further step of defining an exit from said cavity which is in general alignment with said lubricant return passage.

27. The method according to claim 26 comprising the further steps of defining a flow path for suction gas from said suction gas supply passage to the interleaved wraps of the scroll members of said compressor, said path being exterior of said cavity, suction gas being constrained to flow through a plurality of apertures prior to reaching the interleaved wraps of the scroll members of said compressor; and, defining a barrier to the interaction of lubricant flowing out of said cavity with suction gas flowing through the portion of said flow path which is downstream of said plurality of apertures.

28. The method according to claim 23 comprising the further steps of providing a reduced diameter portion of the shell of said compressor in which said motor is directly mounted; providing a larger diameter portion of the shell of said compressor in which an oil sump is defined; and, delivering suction gas into the shell of said compressor in said larger diameter portion of said compressor shell.

29. The method according to claim 28 comprising the further step of interposing a barrier in the larger diameter portion of said compressor between the flow of suction gas entering said larger diameter portion of said compressor and the lubricant sump defined therein.

30. The method according to claim 29 comprising the further step of causing suction gas flowing out of said suction gas supply passage to diverge in a region above said motor and to flow partially therearound outside of said cavity defined by said frame so as to cool the upper portion of said motor prior to being delivered to the interleaved wraps of the scroll members of said compressor.

* * * * *